United States Patent [19]

Carstens, Jr. et al.

[11] 4,061,093

[45] Dec. 6, 1977

[54] TELLER PROTECTION UNIT

[75] Inventors: Bernard A. Carstens, Jr., Cedar Lake, Ind.; Robert L. Carstens, Palos Heights, Ill.

[73] Assignee: Chicago Bullet Proof Equipment Company, Park Forest, Ill.

[21] Appl. No.: 675,720

[22] Filed: Apr. 12, 1976

[51] Int. Cl.[2] ..... E05G 7/00

[52] U.S. Cl. ..... 109/19; 109/21.5

[58] Field of Search ..... 52/208, 209, 397, 732; 109/10, 19, 21.5, 49.5

[56] References Cited

U.S. PATENT DOCUMENTS

| | | | |
|---|---|---|---|
| 1,554,774 | 9/1925 | Zahner | 52/732 X |
| 1,995,819 | 3/1935 | Rogers | 109/21.5 |
| 2,015,868 | 10/1935 | O'Kieffe | 109/10 |
| 3,412,510 | 11/1968 | Harcuba | 52/208 X |
| 3,429,082 | 2/1969 | Strickland et al. | 109/10 X |
| 3,742,872 | 7/1973 | Sexton | 109/19 |

*Primary Examiner*—Casmir A. Nunberg
*Assistant Examiner*—David H. Corbin
*Attorney, Agent, or Firm*—Anthony S. Zummer

[57] ABSTRACT

A teller protection unit is herein disclosed. The teller protection unit includes a frame featuring an interlocking base. A bullet-resistant transparent element is resiliently mounted within the frame. The bullet-resistant transparent element is mounted in a spaced relationship from a portion of the frame. The bullet-resistant transparent element is composed of glass, plastic, acrylic or the like. The frame is adapted to be mounted in a wall. The spaced mounting relationship of the portion of the frame and the bullet-resistant transparent element is adapted to provide a passage for balanced transmission of sound between the bullet-resistant transparent element and the portion of the frame.

4 Claims, 4 Drawing Figures

190
198
178
184
182
192
186
164
158
154
162
156
166
160
194
196
180
188
218
216
200
168
174
22
16
212
214
106
154
82
76
80
74
70
47
104
148
142
146
78
72
68
44
46
144
92
66
152
176
150
32
36
30
102
34
40
42
98
132
170
172
18
100
96
94
118
38
138
136
124
126
26
140
134
84
122
90
88
24
114
120
130
64
62
60
86
112
54
56
28
116
108
58
53
50
52
49
110
51
48
128

TELLER PROTECTION UNIT

BACKGROUND OF THE INVENTION

Teller protection units are well known. A typical teller protection unit has a frame with a piece of bullet-proof or bullet-resistant glass mounted therein. The frame is mounted in a wall. A teller or other person having valuables to be protected, stands on one side of the teller protection unit and customers stand on the other side. The teller and the customers pass articles or valuables back and forth, typically through a deal tray which is a part of the teller protection unit. Communication between tellers and customers is sometimes difficult because the bullet-resistant glass is a laminated glass, having a thickness on the order of several centimeters. The laminated glass is usually flush-mounted with a frame or with extensive supporting members in the frame. As a result, sound can only be effectively communicated through the deal tray which is the only open portion of the teller protection unit. This is an inconvenience for both the teller and the customers because, often, it forces both parties to stoop close to the tray in order to be heard.

Some teller protection units are manufactured with one or more voice transmission boxes positioned near a bottom of the teller protection unit. These voice transmission boxes aid somewhat in transmitting sound from one side of the teller protection unit to the other. However, a person who is trying to hear the person on the opposite side must direct his attention downward and this is an inconvenience. It may be appreciated that when a person's attention is directed downward, for instance, while money is being counted, it is difficult for the person to hear the teller making the count and watch the teller at the same time. As a result, the voice transmission units which are mounted in the bottom of the teller protection unit, offer only a small improvement over acoustical transmission through the tray.

One method has been found for solving this problem, which uses electronics. Microphones are positioned on both sides of the teller protection unit, as are loudspeakers. An amplifier links both sets of microphones and loudspeakers. This system does offer the advantages of clear speech and amplification, but it requires that both parties stay close to their respective microphones so that fading of the signal does not occur and understanding can be clear between both of the parties. In addition, an electronic intercom system of the type described is usually expensive.

What is needed then, is an acoustical transmission system for a teller protection unit which provides uniform balanced acoustical transmission between a major portion of the frame, and the bullet-resistant glass of the teller protection unit. Furthermore, this acoustical transmission system should not detract from the safety which the teller protection unit provides.

SUMMARY OF THE INVENTION

A teller protection unit is herein disclosed. The teller protection unit has a frame. The frame includes an interlocking base, a pair of vertical jamb channels connected perpendicular to the base and a header bar connected to the vertical jamb channels. Each jamb channel is C-shaped and has a longitudinal recess. A plurality of rubber acoustical spacers is positioned within the jamb channel longitudinal recesses.

A laminated bullet-resistant glass element is mountably held within the base and the header bar of the frame. The laminated bullet-resistant glass is held within the longitudinal recesses of the jamb channels. The laminated bullet-resistant glass, however, only contacts the rubber acoustical spacers; the bullet-resistant laminated glass does not contact the jamb channels in which the acoustical spacers are mounted. The longitudinal recesses of the jamb channels have a width slightly greater than a width of the laminated bullet-resistant glass. The bullet-resistant glass does not contact the base or the header bar. As a result, an air space is left between the bullet-resistant glass and the respective jamb channels, the base and the header bar. The air space allows uniform balanced transmission of sound between the laminated bullet-resistant glass and the jamb channels, base and header bar.

It is a principal object of the present invention to provide a teller protection unit which provides full protection for a teller while allowing acoustically balanced transmission of sound from the teller to a customer.

It is another object of the present invention, to provide a teller protection unit which employs acoustical, and not electronic, sound transmission.

It is a still further object of the instant invention, to provide a teller protection unit which is economical to manufacture and may be as conveniently installed as previous teller protection units.

Other objects and uses of the present invention will become obvious to one skilled in the art upon a perusal of the following specification and claims in light of the accompanying drawings.

DESCRIPTION OF THE PREFERRED EMBODIMENT

Figure 1:
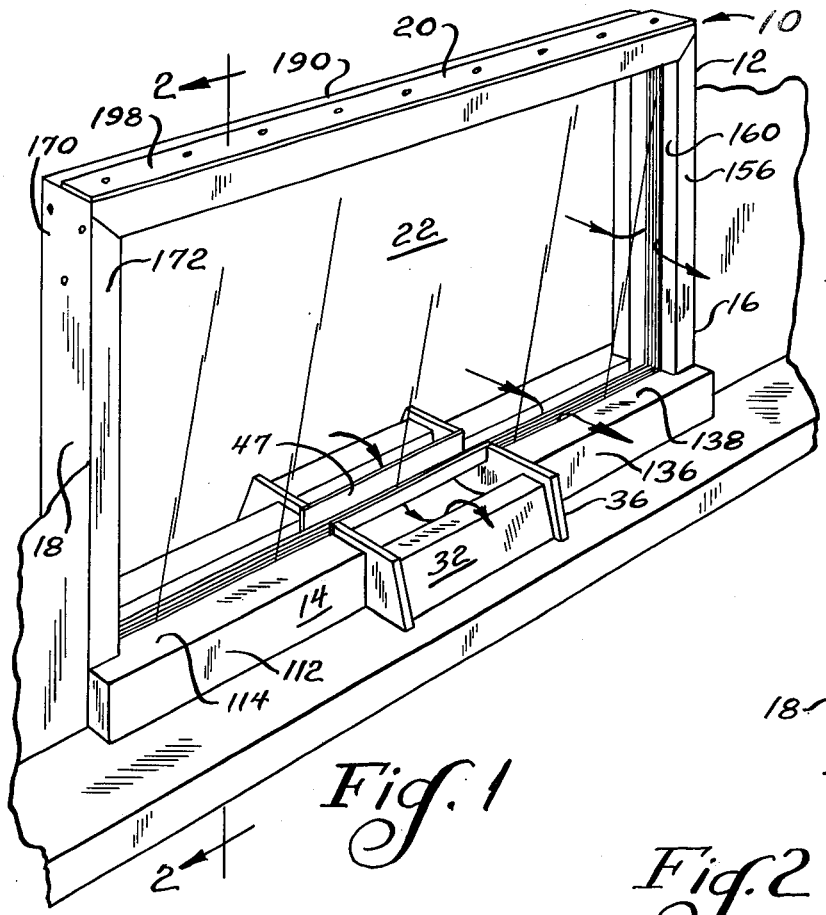
FIG. 1 is a perspective view of an acoustically balanced teller protection unit embodying the present invention mounted in operative engagement with a wall and a shelf.
Figure 2:
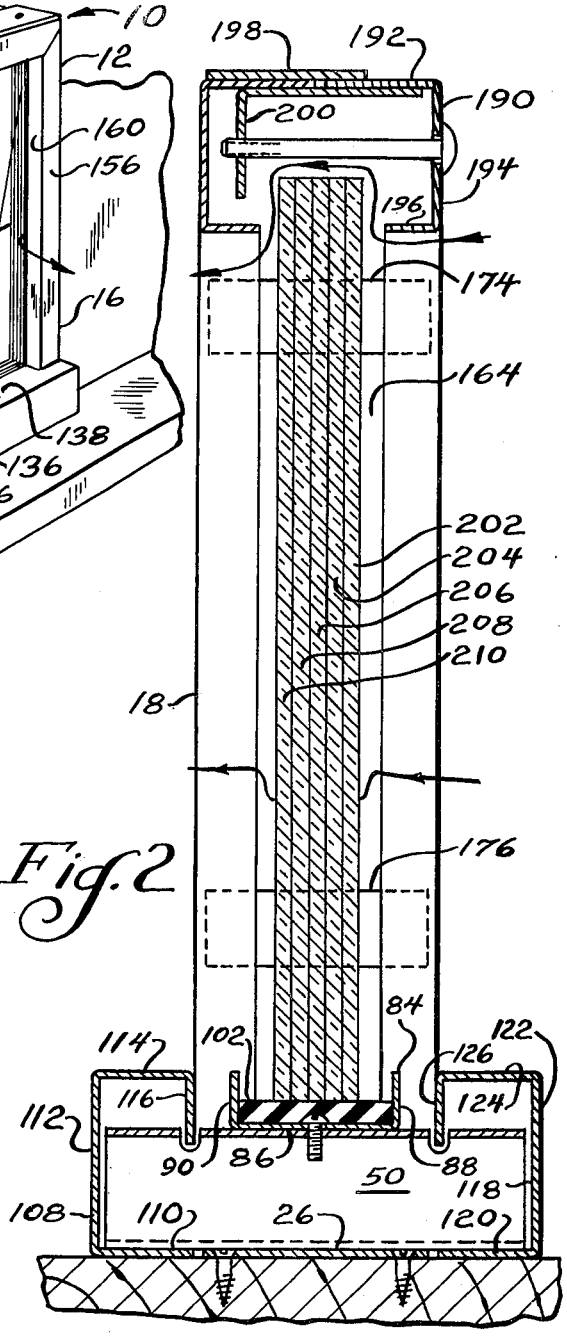
FIG. 2 is a cross-sectional view of the teller protection unit of FIG. 1 taken along line 2—2 of FIG. 1.
Figure 3:
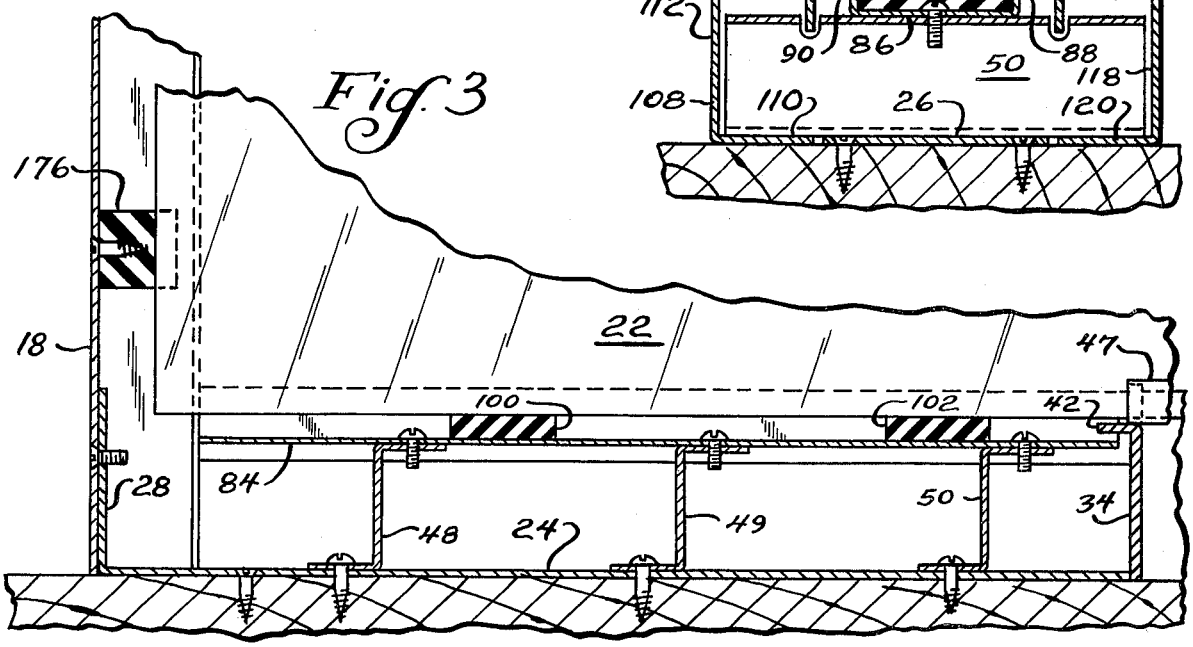
FIG. 3 is a cross sectional, enlarged view of the teller protection unit of FIG. 1, having portions broken away to show details of the relative positions of a bullet-resistant piece of glass and portions of a frame.
Figure 4:
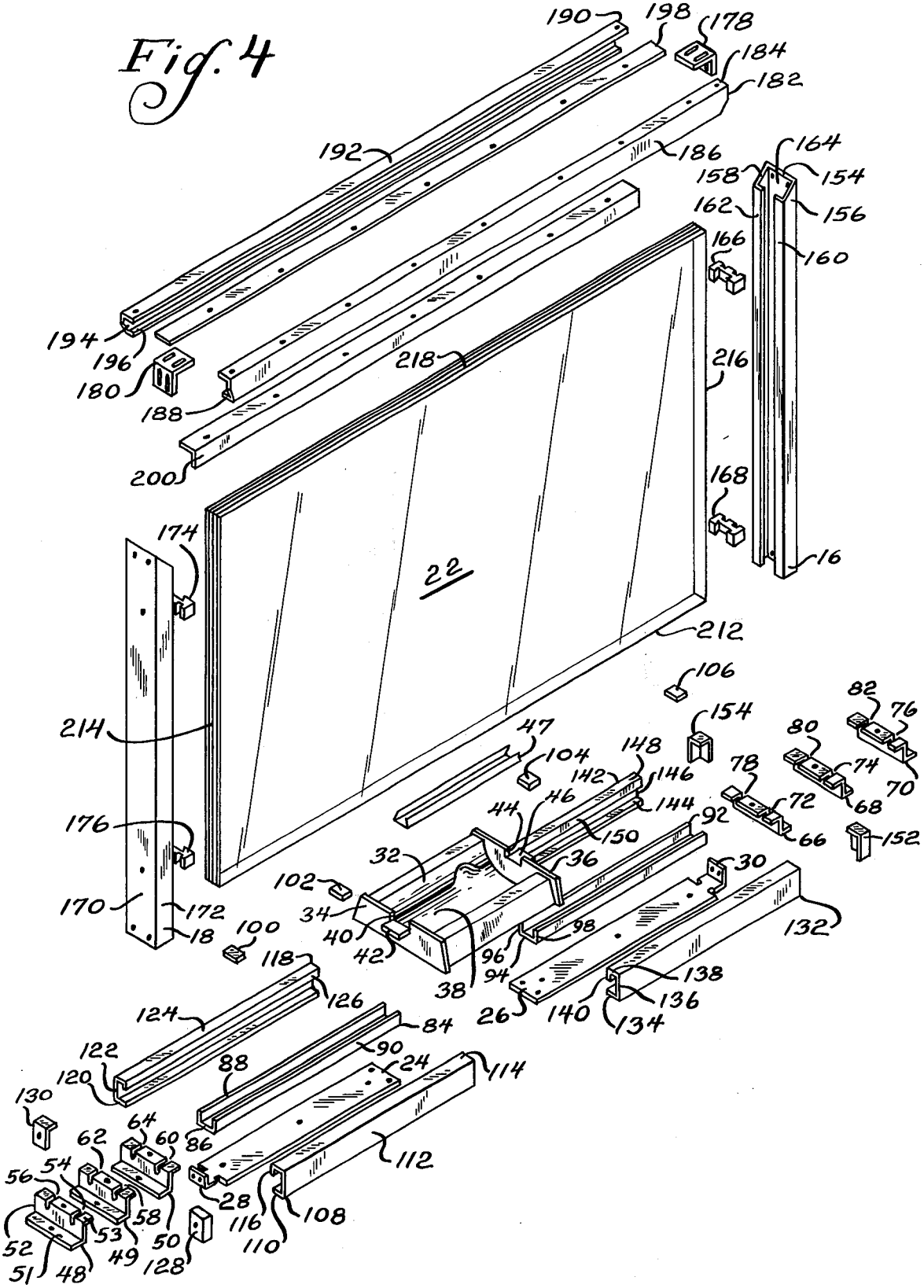
FIG. 4 is an exploded view of the teller protection unit of FIG. 1, showing details of the inter-relationships of elements of the frame of the teller protection unit.

Referring now to the drawings, and especially to FIGS. 1 and 4, a teller protection unit embodying the present invention and bearing the numeral 10 is generally disclosed therein. Teller protection unit 10 has a rectangular frame 12. Rectangular frame 12 has an interlocking base 14. A pair of jamb channels, numbered 16 and 18, is respectively connected at opposite ends of interlocking base 14 perpendicular to interlocking base 14. A header 20, is mounted perpendicular to jamb channels 16 and 18. Rectangular frame 12 is composed of bullet-resistant steel. A piece of laminated bullet-resistant glass 22, is mounted in a spaced relationship from jamb channels 16 and 18. Laminated bullet-resistant glass 22 is a bullet-resistant transparent element.

Interlocking base 14 of frame 12 has a pair of channel bases, respectively numbered 24 and 26. Channel base 24 has a jamb channel bracket 28 formed integral therewith. Channel base 26, identical to channel base 24, has a jamb channel bracket 30 formed integral therewith. Channel bases 24 and 26 are adapted for connection with a bottom portion of a wall opening.

A deal tray 32, generally shaped in a frustum, is positioned between channel bases 24 and 26. Deal tray 32 has a pair of trapezoidal side-walls 34 and 36. A curved carrier portion 38 is positioned between trapezoidal side-walls 34 and 36. Trapezoidal side-wall 34 has a notch 40 formed therein. Immediately adjacent to notch 40 is a horizontally extending tongue 42. Trapezoidal side-wall 36 has a notch 44 formed therein. Immediately adjacent to notch 44 is a horizontally extending tongue 46. A tray channel 47 engages notches 40 and 44 and horizontally extending tongues 42 and 46.

A plurality of Z-clips, respectively numbered 48, 49 and 50, is fixed to channel base 24 in a spaced relationship. Z-clip 48 has a base wing 51. A body portion 52 is formed integral with and perpendicular to base wing 51. A channel wing 53 is formed integral with and perpendicular to body portion 52 opposite base wing 51. Channel wing 53 of Z-clip 48, the exemplary Z-clip, has a pair of U-shaped reliefs 54 and 56 formed therein. Z-clips 49 and 50 are identical to Z-clip 48 and have respective front reliefs 58 and 60 and respective rear reliefs 62 and 64.

Another plurality of Z-clips, respectively numbered 66, 68 and 70, is connected to channel base 26. Z-clips 66, 68 and 70 are identical to the exemplary Z-clip 48. Z-clips 66, 68 and 70 each have a respective front relief numbered 72, 74 and 76. Z-clips 66, 68 and 70 each have a rear relief, respectively numbered 78, 80 and 82.

A center channel 84, having a bottom 86 and a pair of side-walls 88 and 90, is connected to Z-clips 48, 49 and 50, between the front reliefs and the rear reliefs. A center channel 92, having a bottom 94 and a pair of side-walls 96 and 98, is connected to Z-clips 66, 68 and 70 between the front reliefs and the rear reliefs. Center channel 84 has a pair of rectangular rubber bearing pads, respectively numbered 100 and 102, fitted to bottom 86. Center channel 92 has a pair of rectangular rubber bearing pads, respectively numbered 104 and 106, fitted to bottom 94.

A front ledge channel 108 having a shelf face 110, a side face 112, a ledge face 114 and an window lip 116, is fitted beneath Z-clips 48, 49 and 50 adjacent to channel base 24. Front ledge channel 108 has window lip 116 positioned within, but not in contact with, front reliefs 54, 58 and 60 of Z-clips 48, 49 and 50, respectively. Front ledge channel 108 abuts trapezoidal wall 34 of deal tray 32. A rear ledge channel 118 having a shelf face 120, a side face 122, a ledge face 124 and a window lip 126 is fitted beneath Z-clips 48, 49 and 50 adjacent to channel base 24 and opposite front ledge channel 108. Rear ledge channel is identical to front ledge channel 108. Rear ledge channel 118 has window lip 126 positioned within, but not in contact with, rear reliefs 56, 62 and 64, of Z-clips 48, 49 and 50, respectively. Rear ledge channel 118 abuts trapezoidal side-wall 34 of deal tray 32. A pair of end caps, respectively numbered 128 and 130, encloses ledge channels 108 and 118 opposite deal tray 32.

A front ledge channel 132 having a shelf face 134, a side face 136, a ledge face 138 and a window lip 140, is fitted beneath Z-clips 66, 68 and 70 adjacent to channel base 26. Front ledge channel 132 is identical to front ledge channel 108. Front ledge channel 132 has window lip 140 positioned within, but not in contact with, front reliefs 72, 74 and 76 of Z-clips 66, 68 and 70, respectively. Front ledge channel 132 abuts trapezoidal side-wall 36 of deal tray 32. A rear ledge channel 142 having a shelf face 144, a side face 146, a ledge face 148 and a window lip 150 is fitted beneath Z-clips 66, 68 and 70 adjacent to channel base 26 and opposite front ledge channel 132. Rear ledge channel 142 is identical to front channel 108. Rear ledge channel 142 has window lip 150 positioned within, but not in contact with, rear reliefs 78, 80 and 82 of Z-clips 66, 68 and 70, respectively. Rear ledge channel 142 abuts trapezoidal side-wall 36 of deal tray 32. A pair of end caps, respectively numbered 152 and 154, encloses ledge channels 132 and 142 opposite deal tray 32.

Jamb channel 16, having a wall face 154, a pair of side faces respectively numbered 156 and 158 and a pair of jamb channel lips, respectively numbered 160 and 162, is connected to jamb channel bracket 30 of channel base 26. Jamb channel lips 160 and 162 are separated by a short distance. Wall face 154, side faces 156 and 158 and lips 160 and 162 define a longitudinal recess 164. A pair of rubber acoustical spacers, respectively numbered 166 and 168, is fitted within longitudinal recess 164 in contact with wall face 154.

Jamb channel 18 is identical to jamb channel 16. Jamb channel 18 includes a wall face 170 and a side face 172. Jamb channel 18 also has a second wall face and a pair of inwardly extending jamb channel lips. Wall face 170, side face 172, the second side face and the inwardly extending lips define a longitudinal recess identical to the longitudinal recess 164 of jamb channel 16. Jamb channel 18 is connected to jamb channel bracket 28 of channel base 24. A pair of rubber acoustical spacers respectively numbered 174 and 176 is fitted to the longitudinal recess of jamb channel 18.

Header 20 is fixed to jamb channels 16 and 18 by a pair of angle clips respectively numbered 178 and 180. Angle clip 178 is connected at a right angle to jamb channel 16. Angle clip 180 is connected to jamb channel 18. A front header bar 182 is connected across angle clips 178 and 180. Header bar 182 has a top face 184, a side face 186 and a header lip 188. A back header bar 190, identical to front header bar 182, is connected across angle clips 178 and 180 immediately adjacent to front header bar 182. Back header bar 190 has a top face 192, a side face 194 and a header lip 196. A spacing bar 198 is connected to top face 184 of header bar 182. Spacing bar 198 is a flat spacing bar and extends across a portion of top face 192 of back header bar 190. An angle stop bracket 200, having a right angle cross section is connected to front header bar 182 and spacing bar 198.

Bullet-resistant transparent element 22 is composed of laminated bullet-resistant glass. A plurality of glass laminae, respectively numbered 202, 204, 206, 208 and 210, comprise bullet-resistant element 22. Bullet-resistant element 22 is composed of glass, in this embodiment, but can also be composed of plastic or acrylic. Laminated bullet-resistant glass 22 is rectangular and has a bottom edge 212, a pair of vertical side edges 214 and 216 and a top edge 218. Laminated bullet-resistant glass 22 has an approximate thickness of 3 centimeters. Laminated bullet-resistant glass 22 rests on pads 100 and 102 in center channel 84. Laminated bullet-resistant glass 22 does not contact side walls 88 or 90 of center channel 84. Laminated bullet-resistant glass 22 has its bottom edge 212 fitted in engagement with tray channel 47. Tray channel 47 encloses a portion of bottom edge 212 which would otherwise be exposed by deal tray 32. Bottom edge 212 of laminated bullet-resistant glass 22 is also in engagement with rubber bearing pads 104 and 106 in center channel 92. Laminated bullet-resistant glass 22, however, does not contact side walls 96 and 98 of center channel 92. Vertical edge 216 of laminated bullet-resistant glass 22 is engaged by rubber acoustical spacers 166 and 168. Vertical edge 216 lies within longitudinal recess 164, but laminated bullet-resistant glass 22 is not in contact with any portion of jamb channel 16. Channel lips 160 and 162 are spaced a small distance away from laminae 210 and 202, respectively. Likewise, vertical edge 214 is in contact only with rubber acoustical spacers 174 and 176. Vertical edge 214 sits within the longitudinal recess of jamb channel 18 but does not contact jamb channel 18 or either of its respective channel lips. Header bar 20 encloses upper edge 218 of laminated bullet-resistant glass 22 but does not contact laminated bullet-resistant glass 22. Thus, a first air space is left between channel base 24 and 26 and center channels 84 and 92. The first air space is a bottom sound transmission path. There is a second air space left between jamb channel 16 and transparent bullet-resistant element. The second air space is a side sound transmission path. A third air space is provided between the laminated bullet-resistant glass 22 and jamb channel 18. The third air space is another side sound transmission path. A fourth air space is provided between laminated bullet-resistant element 22 and header bar 20. The fourth air space is a top sound transmission path. The bottom side and top of the above mentioned sound transmission paths allow balanced transmission of sound between frame 12 and laminated bullet-resistant element 22. Transmission of sound between laminated bullet-resistant element 22 and frame 12 is, therefore, substantially uniform and natural around all of frame 12.

Teller protection unit 10 is installed in a rectangular wall opening having a shelf, a pair of sides and a top. Channel bases 24 and 26 are connected to the shelf of the wall opening with deal tray 32 between them. Front ledge channel 108 and rear ledge channel 118 are positioned adjacent and parallel to channel base 24 abutting trapezoidal wall 34 of deal tray 32. Z-clips 48, 49 and 50 are then slid under window lips 116 and 126 and on top of shelf faces 110 and 120. Z-clips 48, 49 and 50 are then connected to channel base 24. Center channel 84 is connected to Z-clips 48, 49 and 50 and abuts trapezoidal wall 34 of deal tray 32. Rubber bearing pads 100 and 102 are placed in center channel 84. Similarly, front ledge channel 132 and rear ledge channel 142 are positioned parallel and adjacent to channel base 26 abutting trapezoidal wall 36 of deal tray 32. Z-clips 66, 68 and 70 are slid under window lips 140 and 150 and on top of shelf faces 134 and 144. Z-clips 66, 68 and 70 are then connected to channel base 26. Center channel 92 is connected to Z-clips 66, 68 and 70 and abuts trapezoidal wall 36 of deal tray 32. Rubber bearing pads 104 and 106 are then placed in center channel 92. Jamb channel 16 is bolted to jamb channel bracket 30 at a right angle to channel base 26. Wall face 154 of jamb channel 16 is connected to one of the sides of the wall opening. Jamb channel 18 is bolted to jamb channel bracket 28 at a right angle to channel base 24. Jamb channel 16 is connected to the other side of the wall opening. Angle clip 178 is attached to jamb channel 16 and angle clip 180 is attached to jamb channel 18. Back header 190 and spacing bar 198 are connected to angle clips 178 and 180 and connected to the top of the wall opening.

Laminated, bullet-resistant glass 22 then has tray channel 47 fitted to its bottom edge 212, so that when bullet-resistant, laminated glass 22 is finally installed, tray channel 47 will rest within notches 40 and 44 on tongues 42 and 46 of deal tray 32. Bullet-resistant glass 22 is then slid into jamb channel 16 between lips 160 and 162. Bullet-resistant glass 22 is next rotated into alignment with jamb channel 18 and is slid part way into jamb channel 18 between its respective lips. Acoustical spacers 166 and 168 are slid down longitudinal recess 164 of jamb channel 16 and fixed in resilient engagement with vertical edge 216 of bullet-resistant glass 22 and face 154 of jamb channel 16. Likewise, acoustical spacers 174 and 176 are slid down the longitudinal recess of jamb channel 18 and fixed in resilient engagement with vertical edge 214 of bullet-resistant glass 22 and face 170.

Back header bar 190 and spacing bar 198 have been previously mounted in the wall opening as mentioned above. Front header bar 182 and angle stop bracket 200 are joined to back header bar 190 and spacing bar 198 to enclose top edge 218 of bullet-resistant glass 22. Thus, it can be seen that the present construction allows easy installation of teller unit 10.

Laminated, bullet-resistant glass 22 can withstand impacts to the same extent as previous teller protection units. The air spaces, or sound paths however, allow sound waves to travel between laminated, bullet-resistant glass 22 and frame 12. Thus, sound waves can travel easily between the vertical edges of laminated, bullet-resistant glass 22 and jamb channels 16 and 18 along the side sound paths. Likewise, sound waves can travel through deal tray 32 and between center channels 84 and 92 and their respective channel bases 24 and 26 along the bottom path. Sound can also travel between top edge 218 of glass 22 and header bar 20 along the top path. Since the sound waves thus are transmitted symmetrically around all of frame 12, a natural and balanced sound transmission is achieved without any loss of protection in teller protection unit 10. Since balanced sound is transmitted uniformly between frame 12 and glass 22, neither a teller nor a customer need stoop close to deal tray 32 in order to hear what is being said. A normal stance of both the teller and the customer allows good sound transmission between laminated glass 22 and frame 12.

It may be appreciated that bullet-resistant teller protection unit 10 of the present invention provides protection to a teller or other person while at the same time allowing natural sound transmission through the protective device. Teller protection unit 10 allows balanced and natural sound transmission without the necessity of expensive electronic equipment. Also, teller protection unit 10 is economical to use and easy to install.

Although a specific embodiment of the instant invention has been set forth and described in detail above, it is readily apparent that those skilled in the art may modify the dimensions and make changes in the present invention without departing from the spirit and scope thereof. The instant invention is limited only by the appended claims.

What is claimed is:

1. A teller protection unit comprising: a first channel base; a second channel base positioned adjacent to said first channel base; a first plurality of Z-clips connected to said first channel base; a second plurality of Z-clips connected to said second channel base; a first center channel connected to said first plurality of Z-clips, said first center channel and said first channel base defining a portion of a bottom sound path; a second center channel connected to said second plurality of Z-clips, said second center channel and said second channel base defining another portion of a bottom sound path; a first pair of rubber bearing pads connected to said first center channel; a second pair of rubber bearing pads connected to said second center channel; a frustum-shaped deal tray connected to said first and second channel bases between said first and second center channels, said frustum-shaped deal tray being adapted to allow transmission of goods and sound through said frustum-shaped deal tray; a piece of laminated bullet-resistant glass engaging said first pair and second pair of rubber bearing pads and said tray channel, a first jamb channel connected perpendicular to said first channel base, said first jamb channel having a first pair of rubber acoustical spacers connected thereto, said first jamb channel being positioned in spaced proximity to a first vertical edge of said piece of laminated bullet-resistant glass, said first pair of rubber acoustical spacers resiliently engaging said first vertical edge of said piece of laminated bullet-resistant glass, said first jamb channel and said first vertical edge of said piece of laminated bullet-resistant glass defining a first side sound path; a second jamb channel connected perpendicular to said second channel base, said second jamb channel having a second pair of rubber acoustical spacers connected thereto, said second jamb channel being positioned in spaced proximity to a second vertical edge of said piece of laminated bullet-resistant glass, said second pair of rubber acoustical spacers resiliently engaging said second vertical edge of said piece of laminated bullet-resistant glass, said second jamb channel and said second vertical edge of said piece of laminated bullet-resistant glass defining a second side sound path; a back header bar connected between and perpendicular to said first and second jamb channels; a spacing bar connected to said back header bar; an angle bracket connected to said spacing bar; and a front header bar connected between and perpendicular to said first and second jamb channels, said back header bar, said spacing bar, said angle bracket, said front header bar being positioned in spaced proximity from a top edge of said piece of laminated bullet-resistant glass, said back header bar, said spacing bar, said angle bracket, said fron header bar and said top edge of said piece of laminated bullet-resistant glass defining a top sound path; said bottom sound path, said side sound paths and said top sound path providing balanced and natural sound transmission around said piece of laminated bullet-resistant glass.

2. A teller protection unit comprising; a frame adapted to be mounted in a wall, said frame having a generally U-shaped cross-section with the opening of the U extending inwardly, a bullet-resistant transparent element having a pair of substantially flat opposed surfaces generally symmetrical with the frame resiliently mounted within the frame substantially filling the frame and having its periphery and flat surfaces spaced from adjacent portions of the frame, said frame overlapping portions of the flat surfaces of the bullet-resistant element around the entire periphery of the bullet-resistant element, a rubber bearing pad resiliently supporting a lower edge of the bullet-resistant element a distance away from the interior of the frame sufficient to allow transmission of sound through the space between said lower edge and the adjacent portion of the frame, a first rubber spacer resiliently connecting a first side edge of the bullet-resistant element to the frame and spacing said first side edge from the interior of the frame a distance sufficient to allow transmission of sound through the space between said first side element and the adjacent portion of the frame, said bullet-resistant element having a second side edge opposite the first side edge, a second rubber spacer resiliently connecting the second side edge of the bullet-resistant element to the frame and spacing said second side edge from the interior of the frame a distance sufficient to allow transmission of sound through the space between said second edge and the adjacent portion of the frame, an upper edge of the bullet-resistant element spaced from the interior of the frame a distance sufficient to allow transmission of sound through the space between said upper edge and the adjacent portion of the frame, and a deal tray mounted in the frame adjacent to the lower edge of the bullet-resistant element, whereby the spacing of the bullet-resistant element from the frame provides a passage for balanced transmission of sound from a space on one flat side of the bullet-resistant element to a space on the opposed side of the bullet-resistant element.

3. A teller protection unit as defined in claim 2 in which said bullet-resistant transparent element is laminated bullet-resistant glass.

4. A teller protection unit as defined in claim 2, in which said frame is composed of bullet-resistant steel.

* * * * *